US007391155B2

(12) United States Patent
Jeon

(10) Patent No.: US 7,391,155 B2
(45) Date of Patent: Jun. 24, 2008

(54) PLASMA DISPLAY PANEL WITH IMPROVED BARRIER RIB STRUCTURE

(75) Inventor: Byung-Soo Jeon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 218 days.

(21) Appl. No.: 10/955,003

(22) Filed: Sep. 30, 2004

(65) Prior Publication Data

US 2005/0077821 A1 Apr. 14, 2005

(30) Foreign Application Priority Data

Oct. 1, 2003 (KR) ..... 10-2003-0068389

(51) Int. Cl.
*H01J 61/00* (2006.01)
*H01J 17/49* (2006.01)

(52) U.S. Cl. ..... 313/582; 313/567; 313/584; 313/585; 313/586; 313/587

(58) Field of Classification Search ..... 313/582, 313/586

See application file for complete search history.

(56) References Cited

U.S. PATENT DOCUMENTS

| | | | | |
|---|---|---|---|---|
| 6,023,130 | A * | 2/2000 | Sakasegawa et al. | 313/582 |
| 6,482,575 | B2 * | 11/2002 | Tokai et al. | 430/321 |
| 6,580,227 | B2 * | 6/2003 | Kobayashi | 345/76 |
| 6,965,200 | B2 * | 11/2005 | Kimura et al. | 313/582 |
| 7,176,492 | B2 * | 2/2007 | Chiu | 445/24 |
| 2004/0130265 | A1 * | 7/2004 | Terao et al. | 313/582 |

FOREIGN PATENT DOCUMENTS

| | | | |
|---|---|---|---|
| CN | 1197539 | | 10/1998 |
| CN | 1407583 | | 4/2003 |
| KR | 2001003713 | A * | 1/2001 |
| KR | 1020010003713 | | 1/2001 |
| KR | 1020010019687 | | 3/2001 |
| KR | 1020030013990 | | 2/2003 |
| WO | WO 03023808 | A1 * | 3/2003 |

OTHER PUBLICATIONS

Office action (Paper No. 20060420) dated Apr. 28, 2006 for the cited prior art Chiu U.S. Patent No. 7,176,492.
Amendment and Response under 37 CFR §1.111 filed on Jul. 11, 2006, in response to the Office action (Paper No. 20060420).

* cited by examiner

*Primary Examiner*—Sikha Roy
*Assistant Examiner*—Natalie K Walford
(74) *Attorney, Agent, or Firm*—Robert E. Bushnell, Esq.

(57) ABSTRACT

A plasma display panel having barrier ribs designed to prevent phosphor material from forming on a top surface thereof. The barrier ribs include a plurality of parallel first barrier rib members and a plurality of parallel second barrier rib members formed substantially perpendicularly intersecting the first barrier rib members. The first barrier rib members have a cross-sectional apex width and the second barrier rib members have a cross-sectional apex. The apex width of the first barrier rib members is less than the apex width of the second barrier rib members, so that when the phosphor material is deposited thereon, the phosphor accumulates on the sidewalls of the barrier ribs and between the barrier ribs, and not on top of the barrier ribs, thus improving image quality.

18 Claims, 4 Drawing Sheets

PLASMA DISPLAY PANEL WITH IMPROVED BARRIER RIB STRUCTURE

CLAIM OF PRIORITY

This application makes reference to, incorporates the same herein, and claims all benefits accruing under 35 U.S.C. §119 from an application for PLASMA DISPLAY PANEL WITH IMPROVED BARRIER RIB STRUCTURE earlier filed in the Korean Intellectual Property Office on 1 October and there duly assigned Ser. No. 2003-68389.

BACKGROUND OF THE INVENTION

1. Field of the Invention

The present invention relates to a plasma display panel (PDP) with an improved barrier rib structure. More particularly, the present invention relates to a plasma display panel in which the formation of residual phosphor layer material on upper surfaces of barrier ribs is prevented due to the novel shape of the barrier ribs.

2. Description of the Related Art

A PDP is a display device that realizes the display of images through excitation of phosphors by plasma discharge. That is, a predetermined voltage is applied between two electrodes mounted in a discharge region of the PDP to thereby effect plasma discharge therebetween, and ultraviolet rays generated during plasma discharge excite a phosphor layer formed in a predetermined pattern to thereby form visible images.

One problem with PDPs is that the barrier ribs are formed in such a shape that results in phosphor being deposited and then left on the tops of the barrier ribs in addition to the sidewalls of the barrier ribs and between the barrier ribs on the lower substrate. When bonded together with the upper substrate, the phosphor left on the top surface of the barrier ribs produces cross talk between neighboring discharge cells and limits and degrades the image quality. What is needed is a design for a PDP and a method of making a PDP where phosphor does not remain on top surfaces of barrier ribs.

SUMMARY OF THE INVENTION

It is therefore an object of the present invention to provide an improved design for a PDP.

It is further an object of the present invention to provide a design for a PDP that results in little or no phosphor on top surfaces of barrier ribs.

It is also an object of the present invention to provide a design for a PDP where the barrier ribs are designed to prevent accumulation of phosphor layers on a top surface of barrier ribs.

It is also an object of the present invention to provide a design for a PDP that improves overall brightness for the PDP.

It is further an object of the present invention to provide a design for a PDP that limits crosstalk between neighboring discharge cells.

It is still an object of the present invention to provide a method for making a PDP that limits the accumulation of phosphor materials on a top surface of the PDP.

It is further an object of the present invention to provide a method for making a PDP that results in a PDP with less crosstalk and improved brightness.

These and other objects may be achieved by a PDP in which barrier ribs are structured in such a manner as to limit the amount of phosphor layer material residue left on upper surfaces thereof following deposition of a phosphor layer. A plasma display panel includes a first substrate and a second substrate provided opposing one another with a predetermined gap therebetween, first electrodes formed on the first substrate, second electrodes formed on the second substrate substantially perpendicularly intersecting the first electrodes, barrier ribs mounted in the gap between the first substrate and the second substrate, the barrier ribs defining a plurality of discharge cells, and phosphor layers formed using a phosphor layer material within each of the discharge cells.

The barrier ribs include a plurality of parallel first barrier rib members and a plurality of parallel second barrier rib members formed substantially perpendicularly intersecting the first barrier rib members, the first barrier rib members having a cross-sectional apex width distal from the second substrate and measured substantially along the direction the second barrier rib members are formed, the second barrier rib members having a cross-sectional apex width distal from the second substrate and measured substantially along the direction the first barrier rib members are formed, the apex width of the first barrier rib members being less than the apex width of the second barrier rib members.

The apex width of the first barrier rib members is less than a cross-sectional base width thereof, the base width being measured substantially along the direction the second barrier rib members are formed. If the apex width of the first barrier rib members is (a), and the base width of the first barrier rib members is (c), the following inequality of the ratio of the apex width to the base width ratio is satisfied: $0.035 \leqq a/c \leqq 0.143$.

If a slope of side walls of a cross section of the first barrier rib members taken substantially along the direction the second barrier rib members are formed is (s), the following inequality is satisfied: $1.88 \leqq s \leqq 1.93$. The apex width of the first barrier rib members is between 5 μm and 20 μm. The first barrier rib members are formed along a direction substantially perpendicular to the direction along which the second electrodes are formed. The barrier ribs are formed by etching or sandblasting, and the phosphor layers are formed by a nozzle spray method.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
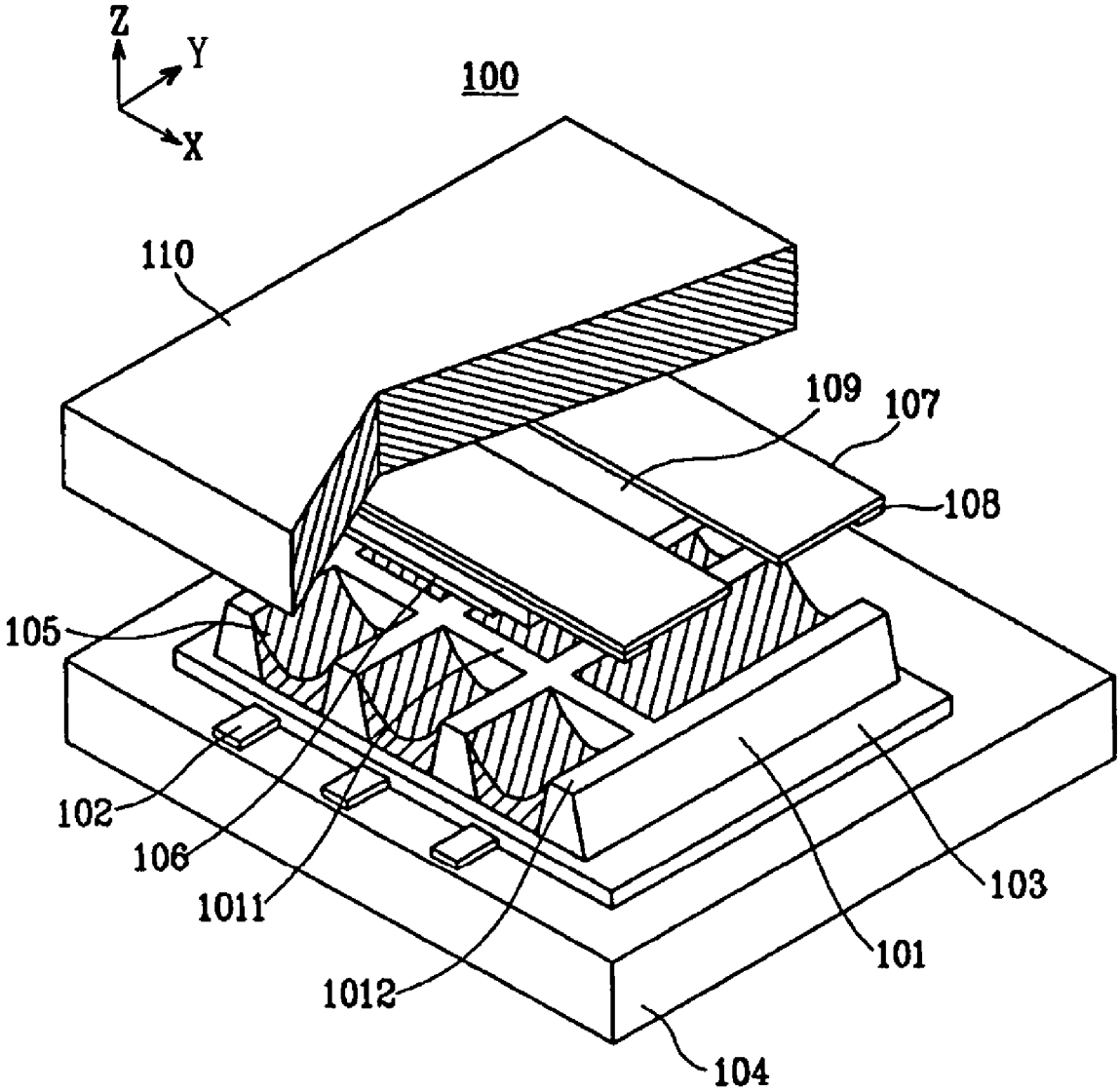
FIG. 1 is a partial exploded perspective view of a plasma display panel.

The different types of PDPs include the AC-PDP, DC-PDP, and the hybrid PDP. FIG. 1 illustrates a partial exploded perspective view of an AC-PDP with a matrix barrier rib configuration. With reference to FIG. 1, an AC-PDP 100 with a closed or matrix barrier rib configuration includes a lower substrate 104 and an upper substrate 110 provided opposing one another with a predetermined gap therebetween. Address electrodes 102 are formed on a top (or +z) surface of the lower substrate 104 and facing the upper substrate 110. The address electrodes 102 are formed in a stripe pattern substantially along a first direction (or y direction). A dielectric layer 103 is formed on the lower substrate 104 covering the address electrodes 102, and a plurality of barrier ribs 101 are formed on the dielectric layer 103. The barrier ribs 101 function to maintain a discharge gap and to prevent crosstalk between neighboring pixels or discharge cells. Phosphor layers 105 are formed on the dielectric layer 103 between the barrier ribs 101, and also on sidewalls of the barrier ribs 101.

The barrier ribs 101 include a plurality of first barrier rib members 1011 formed substantially along a second direction (or x direction) that is perpendicular to the first direction (or y direction), and second barrier rib members 1012 that are formed substantially along the first direction (or y direction) to intersect the first barrier rib members 1011. The barrier ribs 101 are therefore formed in a closed, matrix type of configuration defining individual discharge cells. Such a matrix configuration of the barrier ribs 101 results in superior discharge characteristics compared with barrier ribs formed in a striped pattern.

Formed on a lower surface (or −z surface) of the upper substrate 110 and facing the lower substrate 104 are display electrodes 107 and 108. The display electrodes 107 and 108 are formed substantially along the second direction (or x direction) substantially perpendicular to the address electrodes 102. The display electrodes 107 and 108 are formed such that a pair of the display electrodes are positioned over each of the discharge cells defined by the barrier ribs 101. A dielectric layer 109 and a protection layer 106 are formed on the lower surface (or −z surface) of the upper substrate 110 and covering the display electrodes 107 and 108.

Part of the procedure to manufacture the PDP 100 of FIG. 1 involves deposition of the phosphor layers 105 following formation of the barrier ribs 101. The phosphor layers 105 are typically deposited using a photolithography or a screen printing process. However, with the matrix structure of the barrier ribs 101 as described above, conventional photolithography or screen printing processes result in a quality of the phosphor layers 105 that is lower than desired, as well as the presence of phosphor layer residue being formed on the upper (or +z) surfaces of the barrier ribs 101. The consequence of this latter drawback is a reduction in discharge characteristics, such as the occurrence of crosstalk between adjacent discharge cells.

Figure 2:
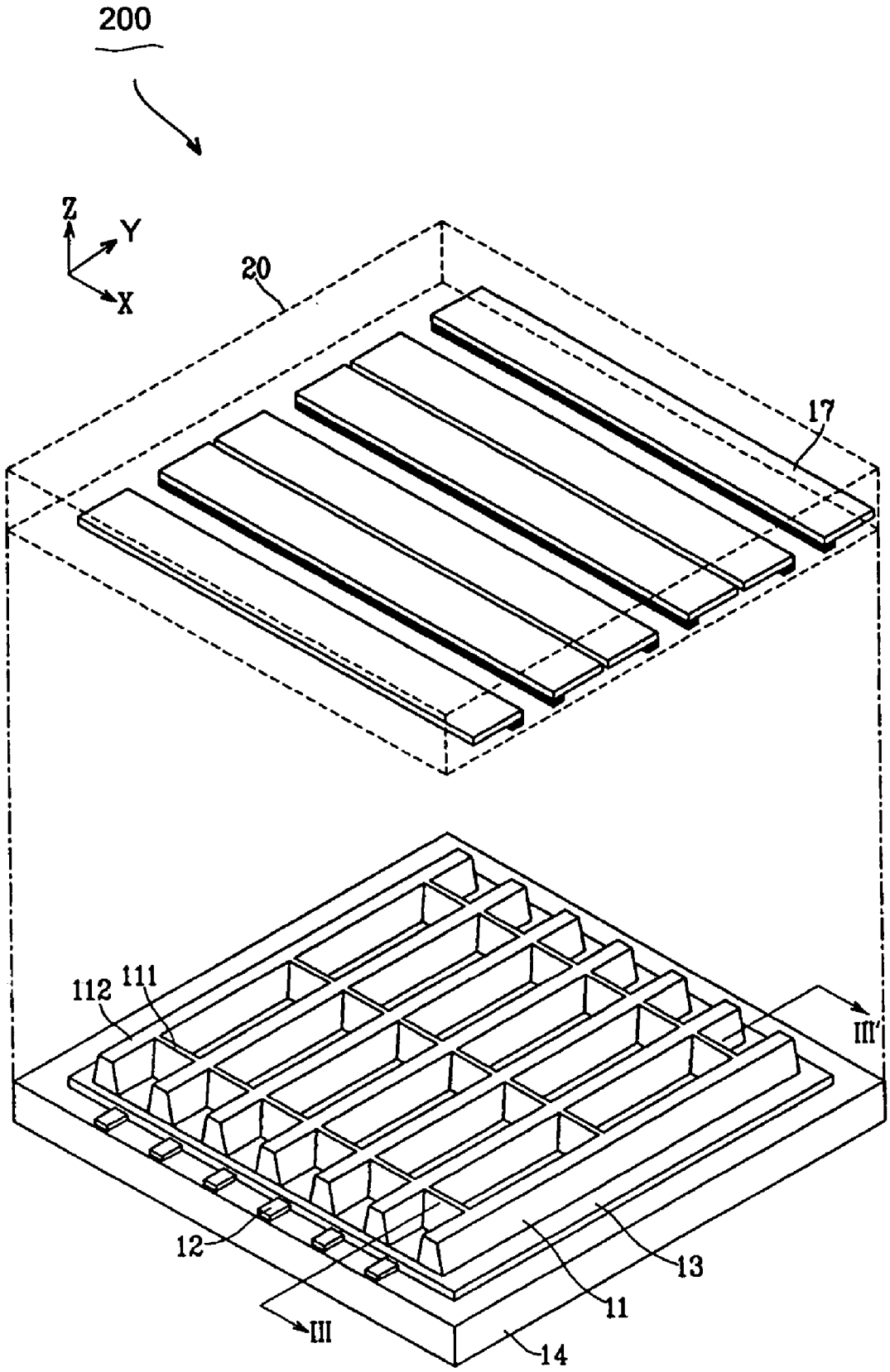
FIG. 2 is a partial exploded perspective view of a plasma display panel according to an exemplary embodiment of the present invention.

FIG. 2 is a partial exploded perspective view of a plasma display panel (PDP) 200 according to an exemplary embodiment of the present invention. The PDP 200 includes a first substrate b 20 and a second substrate 14 provided opposing one another with a predetermined gap therebetween. In FIG. 2, the first and second substrates 20 and 14 are illustrated at an exaggerated distance from each other. Further, the first substrate 20 is illustrated in a transparent manner to allow for viewing of first electrodes 17 mounted on a bottom surface of the first substrate 20 (i.e., the −z surface facing the second substrate 14).

Formed on a top surface (or +z surface) of the second substrate 14 opposing the first substrate 20 is a plurality of second electrodes 12. The second electrodes 12 are formed in a stripe pattern substantially along a y direction. A protective dielectric layer 13 is formed on the second substrate 14 covering the second electrodes 12, and barrier ribs 11 are formed on the dielectric layer 13.

In the exemplary embodiment, the barrier ribs 11 include a plurality of first barrier rib members 111 formed substantially along the x direction and second barrier rib members 112 that are formed substantially along the y direction to thus intersect the first barrier rib members 111. The barrier ribs 11 are therefore formed in a closed, matrix type of configuration defining individual discharge cells by the intersection of the first and second barrier rib members 111 and 112. The barrier ribs 11 are formed in a known manner, such as by using an etching process or sandblasting process. The present invention is not limited to the particular formation of the second barrier rib members 112 illustrated in FIG. 2.

Following the formation of the barrier ribs 11 and sintering of the barrier ribs 11, phosphor layer material (not shown) is deposited on the second substrate 14, in particular, on upper surfaces (or +z surfaces) of the barrier ribs 11, sidewalls of the barrier ribs 11 and on the exposed portions of the dielectric layer 13 between the barrier ribs 11. The phosphor layer material is deposited using known methods, such as photolithography, screen printing, or a nozzle injection method.

In the PDP 200 of the exemplary embodiment described above, application of a drive voltage is applied to the first electrodes 17 and the second electrodes 12 to affect address discharge therebetween, resulting in the formation of a wall charge on the dielectric layer 13. Further, a sustain discharge is applied to a pair of the first electrodes 17 by an AC signal alternately supplied to the pair of the first electrodes 17. The sustain discharge occurs at the discharge cells selected by the address discharge. As a result, ultraviolet rays are generated while discharge gas filled in discharge spaces formed by the discharge cells is excited. The ultraviolet rays excite the phosphor layer material so that it emits visible light, thereby realizing the formation of images.

Figure 3:
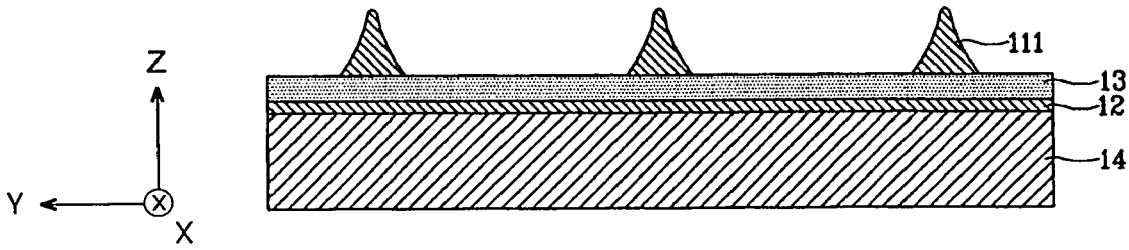
FIG. 3 is a partial sectional view of the plasma display panel taken along line III-III' of FIG. 2.

FIG. 3 is a partial sectional view of the plasma display panel 200 taken along line III-III' of FIG. 2 (i.e., looking in the x direction). As illustrated in FIG. 3, the first barrier rib members 111 are formed on the dielectric layer 13 with predetermined spacing therebetween. The shape of the cross section of first barrier rib member 111 in a portion of PDP 200 away from the second barrier rib member 112 can clearly be seen in FIG. 3. The shape of each of the first barrier rib members 111 will be described in detail below.

Figure 4:
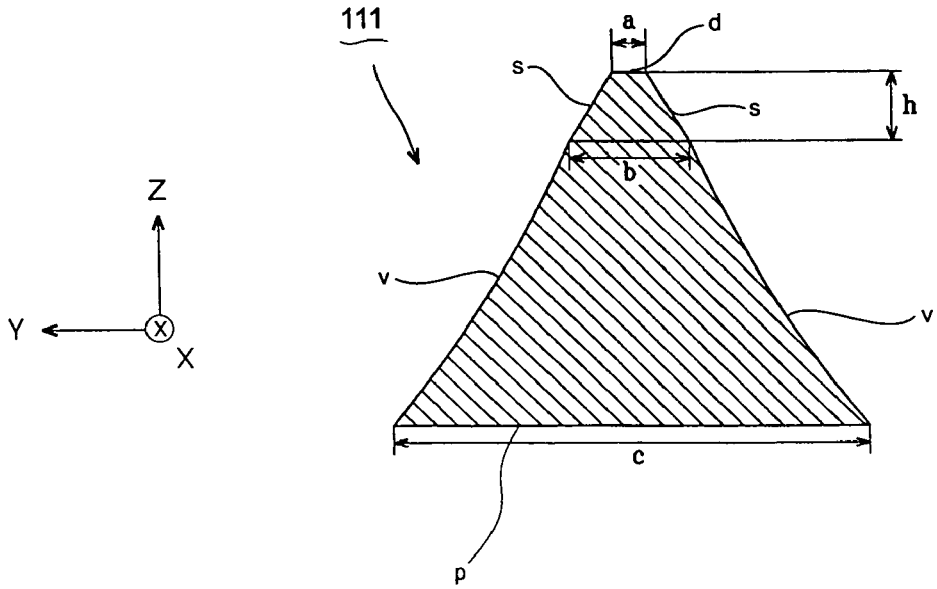
FIG. 4 is a schematic sectional view of a first barrier rib member of the plasma display panel of FIG. 2.

FIG. 4 is a schematic sectional blown-up or close-up view of a cross-section of one of the first barrier rib members 111 of FIG. 3. The first barrier rib member 111 is formed with a width that increasingly reduces as one moves in the +z direction towards a distal end of the first barrier rib member 111 away from the dielectric layer 13. As can be seen in FIG. 4, the sidewalls of the first barrier rib member 111 are sloped. Preferably, the side walls v of the first barrier rib member 111 are slightly concavely shaped from the dielectric layer 13 at the proximal end p of first barrier rib member 111 up to a predetermined point distance h shy of an extreme distal end portion d of the first barrier rib member 111. The overall cross-sectional shape of the first barrier rib member 111 resembles a trapezoid having a base width c measured where the first barrier rib member 111 contacts the dielectric layer 13 as shown in FIG. 3, an apex width a measured along the extreme distal end surface (or top surface or +z surface) d, and an upper end width b measured at a predetermined distance h from the extreme distal end d where the concave formation v discontinues. The first barrier rib member 111 has a predetermined apex-to-base width ratio a/c. The first barrier rib member 111 has an upper end height h between the extreme distal end d and where the measurement of the upper end width b is taken. An approximate slope s of the side walls at the distal end portion d of the first barrier rib member 111 may be obtained as follows: s=2h/(b−a). This formula can readily be derived from FIG. 4 and with the knowledge that the slope s is the change in vertical (h) divided by the change in horizontal (b−a)/2.

Figure 5:
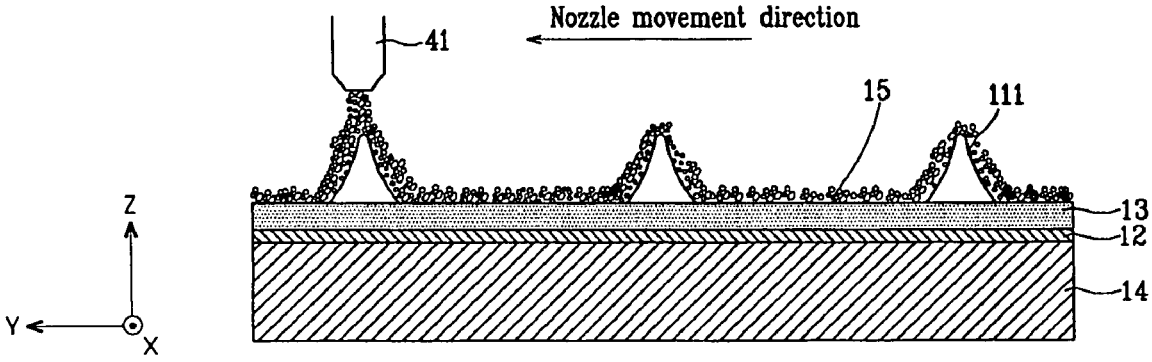
FIG. 5 is a partial sectional view of the plasma display panel of FIG. 2, illustrating the deposition of a phosphor layer material on first barrier rib members.

Referring to FIG. 5, phosphor layer material 15 is deposited on the second substrate 14, in particular, on the dielectric layer 13 and over the first barrier rib members 111, by injecting the phosphor layer material 15 through a nozzle 41. The nozzle 41 is positioned at a predetermined height above the elements formed on the second substrate 14, then is moved along a predetermined nozzle movement direction (y direction) as indicated in the drawing while injecting the phosphor layer material 15 at a predetermined flow rate. During injection, the color of the phosphor layer material 15 is typically varied in succession between red, green, and blue colors.

By varying the dimensions of the first barrier rib members 111 (i.e., the apex width (a), upper end width (b), base width (c), upper end height (h), and slope (s)) to specific levels, the phosphor layer material 15 is prevented from being left remaining on the extreme distal end surfaces d (or +z surface) of the first barrier rib members 111, and instead flows down the side walls thereof. Furthermore, such deliberate control of these dimensions ensures that good deposition on the side walls of the first barrier rib members 111 takes place.

In the following, there will be described different embodiments representing experiments that were performed to obtain suitable ranges for the apex-to-base ratio a/c, slope (s), and apex width (a) for the first barrier rib members 111.

EMBODIMENTS

In the embodiments that will be described below, the upper end width (b) was set at approximately 60.0 μm, and the base width (c) was set at approximately 140.0 μm. As previously described, the experiments of the following embodiments were performed in an effort to obtain suitable ranges for the dimensions of the first barrier rib members. It is to be understood that what is described below are merely examples of the possible different embodiments, and the present invention is not limited to the same. Empirical results regarding brightness and phosphor layer material content were obtained for different values of apex a and apex-to-base ratio a/c.

Embodiment 1

In Embodiment 1, an etching method was used to form the barrier ribs having the apex width (a) of approximately 60.0 μm. Next, the phosphor layer material was deposited while controlling a deposition speed and deposition pressure. The deposition speed was set at roughly 100 mm/sec, and the deposition pressure was varied between 0.5 Mpa and 0.6 Mpa so that a deposition thickness corresponded to a standard thickness. Following deposition of the phosphor layer material, sintering was performed for one hour, which included heating at a temperature of 480° Celsius for ten minutes, and cooling for the remaining 50 minutes.

The PDP was then assembled following deposition of the phosphor layer material as described above. Light intensity was measured in a peak state using an illuminance meter (CA-100), the result of which, measured in units of cd/m$^2$, was a brightness of 875 cd/m$^2$. Further, the thickness of the deposited phosphor layer material was measured per unit area, and a standardized phosphor layer material content of 4840 cm$^3$ was obtained.

Embodiment 2

Except for setting the apex width (a) at 20.0 μm, all other aspects of Embodiment 2 were identical to Embodiment 1. Measurements taken yielded a brightness of 972 cd/m$^2$, and a phosphor layer material content of 5162 cm$^3$.

Embodiment 3

Except for setting the apex width (a) at 10.0 μm, all other aspects of Embodiment 3 were identical to Embodiment 1. Measurements taken yielded a brightness of 982 cd/m$^2$, and a phosphor layer material content of 5640 cm$^3$.

Embodiment 4

Except for setting the apex width (a) at 6.6 μm, all other aspects of Embodiment 4 were identical to Embodiment 1. Measurements taken yielded a brightness of 1000 cd/m$^2$, and a phosphor layer material content of 5901 cm$^3$.

Embodiment 5

Except for setting the apex width (a) at 5.0 μm, all other aspects of Embodiment 5 were identical to Embodiment 1. Measurements taken yielded a brightness of 1110 cd/m$^2$, and a phosphor layer material content of 6287 cm$^3$.

Embodiment 6

Except for setting the apex width (a) at 4.0 μm, all other aspects of Embodiment 6 were identical to Embodiment 1. Measurements taken yielded a brightness of 943 cd/m$^2$, and a phosphor layer material content of 6893 cm$^3$.

The empirical results of Embodiments 1-6 are summarized in the following Table 1.

TABLE 1

| | Apex width a | a/c | Phosphor layer material content | Brightness |
|---|---|---|---|---|
| Embodiment 1 | 60.0 μm | 0.429 | 4840 cm$^3$ | 875 cd/m$^2$ |
| Embodiment 2 | 40.0 μm | 0.286 | 5162 cm$^3$ | 972 cd/m$^2$ |
| Embodiment 3 | 20.0 μm | 0.143 | 5640 cm$^3$ | 982 cd/m$^2$ |
| Embodiment 4 | 10.0 μm | 0.071 | 5901 cm$^3$ | 1000 cd/m$^2$ |
| Embodiment 5 | 5.0 μm | 0.035 | 6287 cm$^3$ | 1110 cd/m$^2$ |
| Embodiment 6 | 1.0 μm | 0.007 | 6893 cm$^3$ | 943 cd/m$^2$ |

As illustrated in Table 1, Embodiments 2-5 obtained a high phosphor layer material content, as well as improved levels of brightness compared with Embodiment 1. In the case of Embodiment 6, with the increase in the phosphor layer material content occurring as a result of a reduction in the apex-to-base ratio a/c, it may be assumed that the phosphor layer material content remaining on the extreme distal end surfaces d of first barrier rib members 111 is reduced. However, this caused a reduction in brightness, as well as an excessively thin profile. The end result is that an ideal apex-to-base ratio a/c falls within the range of 0.035-0.143.

The following experiments were performed in order to determine suitable levels for the slope (s) of the side walls at the distal end portions of the first barrier rib members.

Embodiment 7

Except for making the side walls at the distal end portions of the first barrier rib members have a slope (s) of 1.82, all other aspects of Embodiment 7 were identical to Embodiment 1. Measurements taken yielded a brightness of 823 cd/m$^2$ and a phosphor layer material content of 4523 cm$^3$.

Embodiment 8

Except for making the side walls at the distal end portions of the first barrier rib members have a slope (s) of 1.85, all other aspects of Embodiment 8 were identical to Embodiment 1. Measurements taken yielded a brightness of 875 cd/m$^2$ and a phosphor layer material content of 4893 cm$^3$.

Embodiment 9

Except for making the side walls at the distal end portions of the first barrier rib members have a slope (s) of 1.88, all other aspects of Embodiment 9 were identical to Embodiment 1. Measurements taken yielded a brightness of 932 cd/m$^2$ and a phosphor layer material content of 5234 cm$^3$.

Embodiment 10

Except for making the side walls at the distal end portions of the first barrier rib members have a slope (s) of 1.91, all other aspects of Embodiment 10 were identical to Embodiment 1. Measurements taken yielded a brightness of 976 cd/m$^2$ and a phosphor layer material content of 5452 cm$^3$.

Embodiment 11

Except for making the side walls at the distal end portions of the first barrier rib members have a slope (s) of 1.93, all other aspects of Embodiment 11 were identical to Embodiment 1. Measurements taken yielded a brightness of 984 cd/m$^2$ and a phosphor layer material content of 5534 cm$^3$.

Embodiment 12

Except for making the side walls at the distal end portions of the first barrier rib members have a slope (s) of 1.96, all other aspects of Embodiment 12 were identical to Embodiment 1. Measurements taken yielded a brightness of 895 cd/m$^2$ and a phosphor layer material content of 5632 cm$^3$.

TABLE 2

| | Side wall slope (s) | Phosphor layer material content | Brightness |
|---|---|---|---|
| Embodiment 7 | 1.82 | 4523 cm$^3$ | 823 cd/m$^2$ |
| Embodiment 8 | 1.85 | 4893 cm$^3$ | 875 cd/m$^2$ |
| Embodiment 9 | 1.88 | 5234 cm$^3$ | 932 cd/m$^2$ |
| Embodiment 10 | 1.91 | 5452 cm$^3$ | 976 cd/m$^2$ |
| Embodiment 11 | 1.93 | 5534 cm$^3$ | 984 cd/m$^2$ |
| Embodiment 12 | 1.96 | 5632 cm$^3$ | 895 cd/m$^2$ |

As shown in Table 2, Embodiments 9-11 obtain a relatively high phosphor layer material content, as well as satisfactory levels of brightness. In the case of Embodiment 12, although an increase in the phosphor layer material content was obtained as a result of the increase in the side wall slope (s), the brightness, on the other hand, was reduced.

It may be determined from the above embodiments that when the apex width (a) is formed to between 5 μm and 20 μm, the amount of phosphor layer material left remaining on the distal end surfaces d of the first barrier rib members 111 is significantly reduced. This range is determined also from the following factors: when the apex width (a) is formed to less than 5 μm, there is a high possibility the barrier ribs will be damaged or even crumble during the sandblasting process, and when the apex width (a) is formed to greater than 20 μm, the brightness of the PDP is markedly reduced. It may be known through the above embodiments that discharge characteristics may be improved by varying the formation of the first barrier rib members.

In the PDP of the exemplary embodiment of the present invention, by forming the upper end widths of the first barrier rib members to be less than that of the second barrier rib members, the amount of residual phosphor layer material on the distal end surfaces of the first barrier rib members is reduced. Therefore, crosstalk between adjacent discharge cells and mis-discharge may be prevented.

Further, by setting the cross-sectional apex widths of the first barrier rib members to be less than their cross-sectional base widths such the ratio therebetween (i.e., apex-to-base ratio) is between 0.035 and 0.143, and by setting the slopes of the side walls of the first barrier ribs members to between 1.88 and 1.93, the residual phosphor layer material on the distal end surfaces of the first barrier rib members can be further reduced. As described above, it has been determined that setting the apex width to less than 5 μm may cause damage to the barrier ribs during the sandblasting process, and when set to greater than 20 μm, the brightness of the PDP is reduced.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel, comprising:

a first substrate and a second substrate provided opposing one another with a predetermined gap therebetween;

a plurality of display electrodes arranged on the first substrate;

a plurality of address electrodes arranged on the second substrate substantially perpendicular to and intersecting the display electrodes;

barrier ribs arranged in the gap between the first substrate and the second substrate, the barrier ribs dividing the gap between the first and the second substrates into a plurality of discharge cells; and phosphor layers comprising a phosphor layer material arranged within each of the discharge cells, wherein the barrier ribs comprise a plurality of parallel first barrier rib members arranged in a direction crossing a longitudinal direction of the address electrodes and a plurality of parallel second barrier rib members arranged substantially perpendicular to and intersecting the first barrier rib members, wherein a first portion of a sidewall of the first barrier rib members being concave and a second portion of a sidewall of the first barrier rib members having a constant slope (s) satisfying the inequality $1.88 \leqq s \leqq 1.93$, wherein an apex width (a) of a top portion of the first barrier rib members being less than a base width (c) of the first barrier rib members.

2. The plasma display panel of claim 1, wherein the second portion of the sidewall of the first barrier rib members being near a top of the first barrier rib members and the first portion of the sidewall of the first barrier rib members being near a bottom of the first barrier rib members further away from a front viewing side of the plasma display panel than the second portion.

3. The plasma display panel of claim 1, wherein a ratio a/c of the apex width of the first barrier rib members (a) to the base width of the first barrier rib members (c) satisfies the inequality $0.035 \leqq a/c \leqq 0.143$.

4. The plasma display panel of claim 1, wherein the apex width (a) of the first barrier rib members is between 5 μm and 10 μm.

5. The plasma display panel of claim 1, wherein the first barrier rib members are formed along a direction substantially perpendicular to the direction along which the second electrodes are formed.

6. The plasma display panel of claim 1, wherein the phosphor layers are produced by a nozzle spray process.

7. The plasma display panel of claim 1, wherein adjoining ones of the plurality of discharge cells divided by one of the plurality of first barrier rib members, have phosphor layers of a same color.

8. The plasma display panel of claim 1, wherein adjoining ones of the plurality of discharge cells divided by one of the plurality of second barrier rib members, have phosphor layers of a different colors.

9. A plasma display panel, comprising:

a first substrate and a second substrate provided facing one another with a predetermined space arranged between the first and the second substrates;

a plurality of first electrodes arranged on the first substrate;

a plurality of second electrodes arranged on the second substrate substantially perpendicular to and intersecting the first electrodes;

barrier ribs arranged in the space between the first substrate and the second substrate, the barrier ribs dividing said space into a plurality of discharge cells; and a phosphor layer material arranged within each of the discharge cells, wherein the barrier ribs comprise a plurality of parallel first barrier rib members and a plurality of parallel second barrier rib members arranged substantially perpendicular to and intersecting the first barrier rib members, the first barrier rib members having a top surface that is between 5 and 20 microns wide, a ratio of the width of the top surface to a width at a base of the first barrier rib members being between 0.035 and 0.143.

10. The plasma display panel of claim 9, wherein sidewalls of the first barrier rib members include a first portion that is concavely curved and a second portion that has a constant slope.

11. The plasma display panel of claim 10, the constant slope of the second portion of the first barrier rib members being between 1.88 and 1.93.

12. The plasma display panel of claim 11, the first barrier rib members being adapted to prevent an accumulation of the phosphor layer material on the top surface upon application of the phosphor layer material.

13. The plasma display panel of claim 10, the second portion of the first barrier rib members being closer to the top surface of the first barrier rib members than the first portion and being closer to a front viewing side of the plasma display panel than the first portion.

14. The plasma display panel of claim 9, wherein a cross section of the second portion of the first barrier rib members being of a trapezoid shape.

15. The plasma display panel of claim 9, wherein adjoining ones of the plurality of discharge cells divided by one of the plurality of first barrier rib members, have phosphor layers of a same color.

16. A plasma display panel, comprising:

a first substrate and a second substrate provided facing one another with a predetermined space arranged between the first and the second substrates;

a plurality of display electrodes arranged on the first substrate;

a plurality of address electrodes arranged on the second substrate substantially perpendicular to and intersecting the first electrodes;

barrier ribs arranged in the space between the first substrate and the second substrate, the barrier ribs dividing said space into a plurality of discharge cells; and a phosphor layer material arranged within each of the discharge cells, wherein the barrier ribs comprise a plurality of parallel first barrier rib members arranged in a direction crossing a longitudinal direction of the address electrodes and a plurality of parallel second barrier rib members arranged substantially perpendicular to and intersecting the first barrier rib members, the first barrier rib members having a cross section essentially in a shape of a trapezoid, the first barrier rib members having a slope near a distal portion between 1.88 and 1.93 and is concave beneath the distal portion.

17. The plasma display panel of claim 16, a width of a distal end of the first barrier rib members being less than 20 microns.

18. The plasma display panel of claim 16, a width of a distal end of the first barrier rib members being between 5 and 20 microns.

* * * * *